United States Patent [19]

Gidseg et al.

[11] Patent Number: 4,774,740

[45] Date of Patent: Oct. 4, 1988

[54] DOOR HINGE

[75] Inventors: Edward D. Gidseg, 16 Duke of Gloucester, Manhasset, N.Y. 11030; Jan Ganik, Fresh Meadows, N.Y.

[73] Assignee: Edward D. Gidseg, Manhasset, N.Y.

[21] Appl. No.: 855,050

[22] Filed: Apr. 23, 1986

[51] Int. Cl.[4] ..... E05D 11/10

[52] U.S. Cl. ..... 16/344; 16/351

[58] Field of Search ..... 16/341, 344, 347, 351, 16/363

[56] References Cited

U.S. PATENT DOCUMENTS

| | | | |
|---|---|---|---|
| 54,618 | 5/1866 | Slusser | 16/351 |
| 393,200 | 11/1888 | Abbott | 16/344 |
| 420,997 | 2/1890 | Hess | 16/351 |
| 542,051 | 7/1895 | Heller | 16/344 |
| 874,746 | 12/1907 | Dennis | 16/344 |
| 889,834 | 6/1908 | Waters | 16/344 |
| 1,062,623 | 5/1913 | Waters | 16/351 |
| 1,294,044 | 2/1919 | Buckwalter | 16/351 |
| 1,612,462 | 12/1926 | Mumford | 16/351 |
| 3,205,532 | 9/1965 | MacDonald | 16/180 |
| 3,228,058 | 1/1966 | MacDonald | 16/184 |
| 3,262,149 | 7/1966 | Gorton et al. | 16/147 |
| 3,335,454 | 8/1967 | Dunster | 16/189 |
| 3,381,332 | 5/1968 | Jerila et al. | 16/139 |
| 3,391,420 | 7/1968 | Anderson | 16/139 |
| 3,418,683 | 12/1968 | Stone et al. | 16/145 |
| 3,577,840 | 5/1971 | Buberniak | 16/142 |
| 3,628,845 | 12/1971 | Grimm | 312/319 |
| 4,090,274 | 5/1978 | Bourgeois | 16/153 |
| 4,170,391 | 10/1979 | Bottger | 312/214 |
| 4,340,991 | 7/1982 | Gidseg | 16/254 |
| 4,424,607 | 1/1984 | Langenhorst | 16/387 |

FOREIGN PATENT DOCUMENTS

| | | | |
|---|---|---|---|
| 642116 | 8/1928 | France | 16/351 |
| 207681 | 3/1909 | Fed. Rep. of Germany | 16/351 |
| 476789 | 5/1929 | Fed. Rep. of Germany | 16/351 |

*Primary Examiner*—Kurt Rowan

*Attorney, Agent, or Firm*—Pennie & Edmonds

[57] ABSTRACT

A hinge for rotatably mounting a barrier member to structural means which comprises first hinge mounting means having means for attachment thereof to the structural means; second hinge mounting means having means for attachment thereof to the barrier member; a first hinge member mounted for rotation with the second hinge mounting means; a second hinge member positioned in engagement with the first hinge member and means for preventing rotation of the second hinge member with respect to the first mounting means. Each hinge member has corresponding engaging surfaces configured to permit a staged rotation of the barrier means into a plurality of predetermined positions. Applicants have also developed a novel method for constructing the hinge of the invention.

24 Claims, 5 Drawing Sheets

FIG. 6
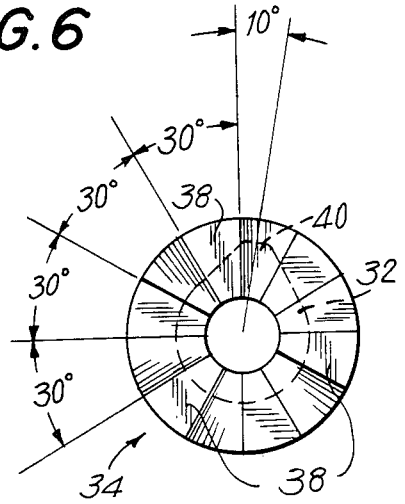
FIG. 3
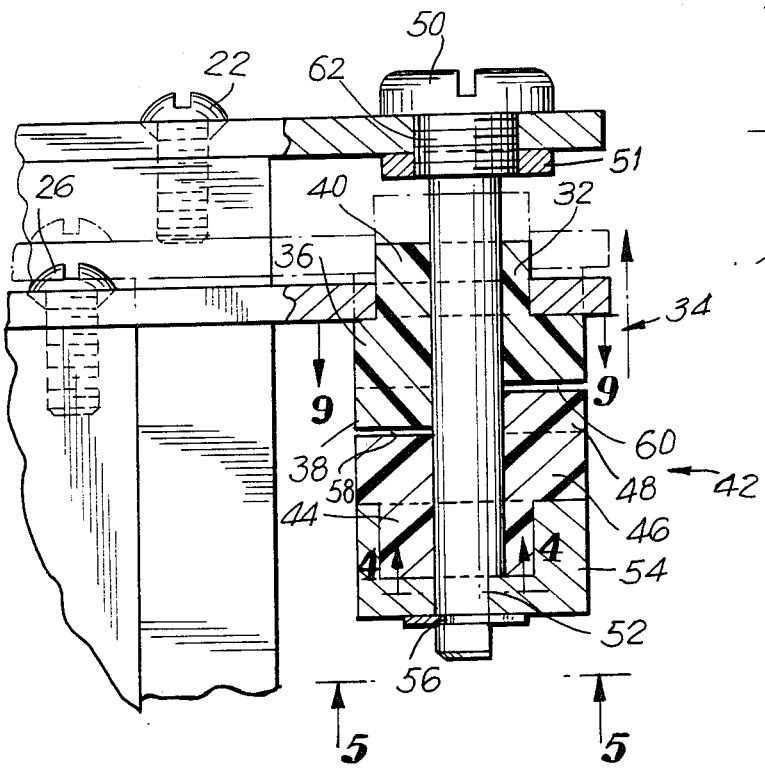
FIG. 7
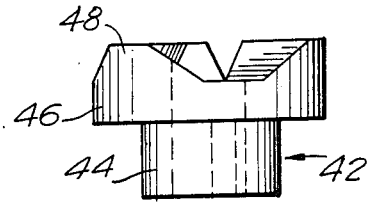
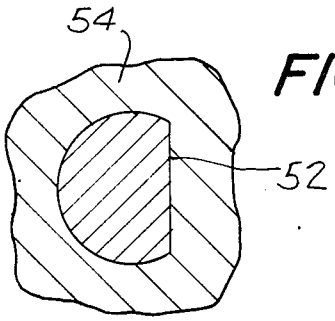
FIG. 4
FIG. 8
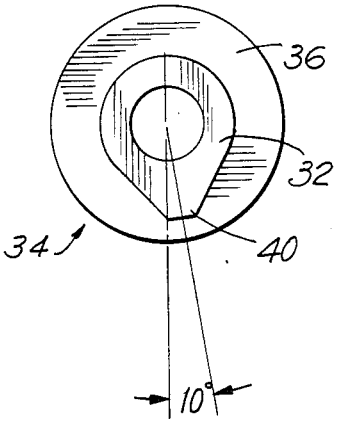
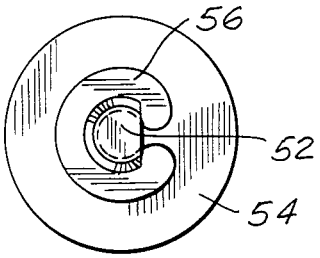
FIG. 5

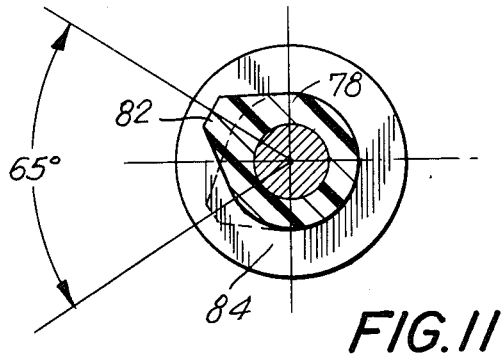
FIG. 11
FIG. 12
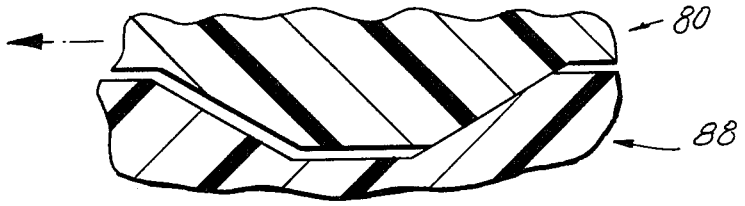
FIG. 13
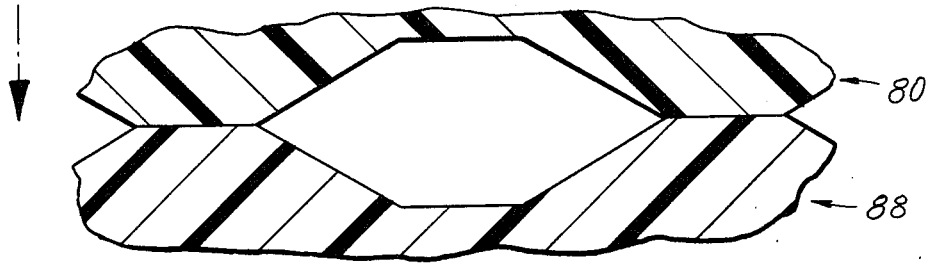
FIG. 14
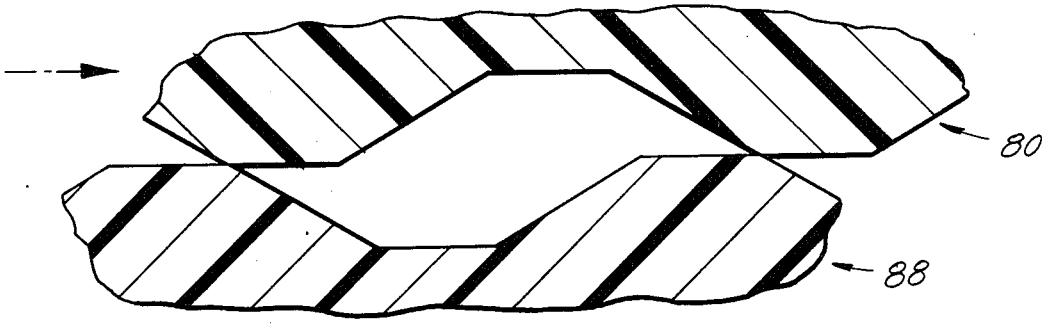
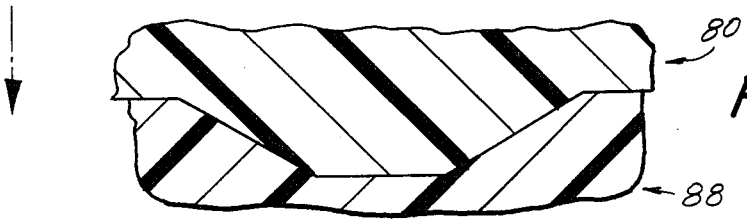
FIG. 15

FIG. 16
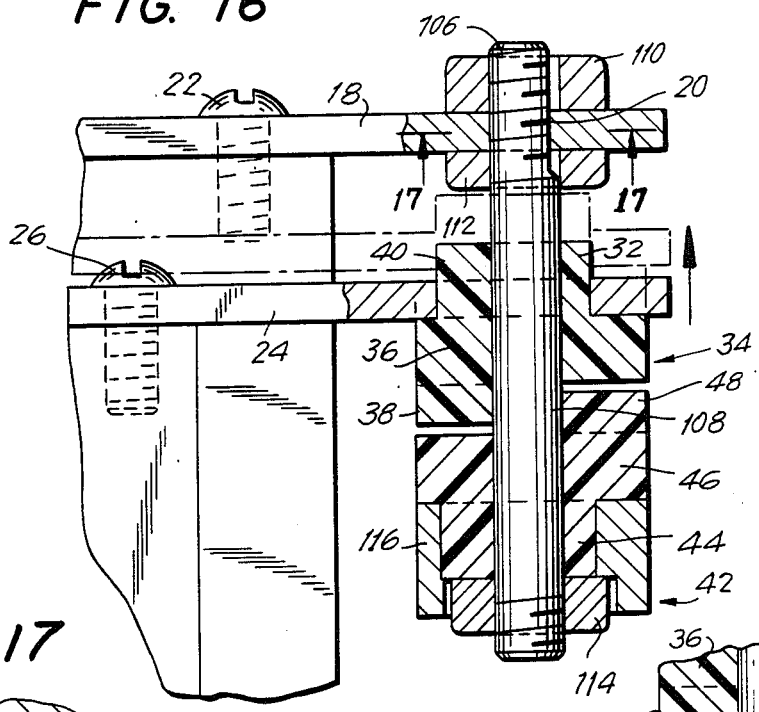
FIG. 17
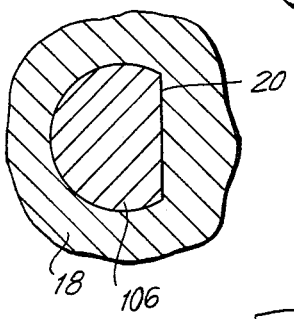
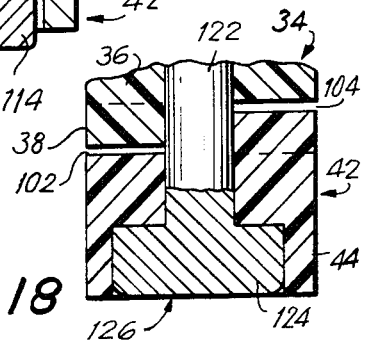
FIG. 18
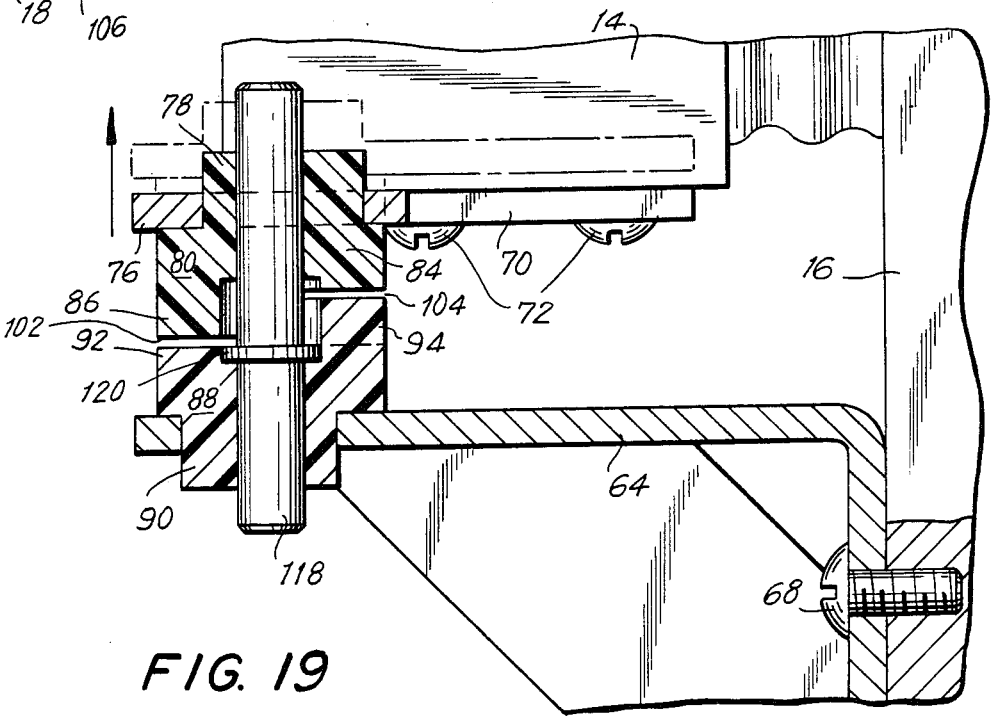
FIG. 19

DOOR HINGE

TECHNICAL FIELD

This invention relates to a hinge for mounting a door to a frame. In particular, the invention relates to a door hinge for a refrigeration cabinet which hinge provides self closing of the door for a certain range of opening, free movement of the door over other degrees of opening, and outward urging over still other degrees of opening.

BACKGROUND ART

A wide variety of hinges are currently available and well known to those skilled in the art. a number of these hinges, such as those disclosed in U.S. Pat. Nos. 3,205,532, 3,228,058, 3,262,149, 3,381,332, 3,391,420, 3,418,683, 3,577,840, and 4,340,991 are described as "self latching" hinges, in that they provide a spring-loaded hinge for urging the door to a closed position as it is moved through one portion of its range of motion and further wherein the hinge is disabled from acting on the door when the door is moved to other positions. These hinges also include various types of self latching devices to maintain the door in its closed position. Some of these patents also disclose the provision of an "over-center" position so as to bias the hinge to provide a stronger hold on the door in a closed position.

These patents all disclose hinges which are of relatively complicated construction, or which require complex spring assemblies for proper operation. Other disadvantages include the use of different parts for left hand opening and right hand opening doors, the criticality of proper alignment for installing the hinge, or the relatively large size of the hinge.

We have invented a method of making a new hinge assembly which overcomes the aforementioned difficulties providing stepped door movements and biased closed and opened door positions. The hinge is comprised of a minimal amount of easily manufactured components which are relatively simple to align and which require no complex spring assembly. The same assembly may be used for left hand opening and right hand opening doors and the size of the hinge assembly need not be increased in order to performed the claimed functions.

SUMMARY OF THE INVENTION

The invention relates to a hinge for rotatably mounting a barrier member to a structural means which comprises first hinge mounting means having means for attachment to the structural means, second hinge mounting means having means for attachment thereof to the barrier member, a first hinge member mounted for rotation with the second hinge mounting means, a second hinge member positioned in engagement with the first hinge member and means for preventing rotation of the second hinge member with respect to the first mounting means.

The first and second hinge members each have engaging surfaces which are correspondingly configured to permit a staged rotation of the first hinge member and the second mounting means, thereby facilitating a staged rotation of the barrier means in predetermined sequential increments as determined by the respective engaging surfaces.

The engaging surfaces of the hinge have corresponding engagement means to retain the first hinge member and second mounting means in a predetermined position which thereby maintains the barrier member in at least one of a plurality of predetermined positions with respect to the structural means. The corresponding engagement means comprise a plurality of substantially identical crenulations, each having oppositely sloped sides. The hinge as disclosed herein is capable of maintaining said barrier member in one of at least three locations, which correspond to a closed position, an intermediate position and an open position.

A particular feature of the present invention relates to to the provision of hinge means for mounting a door to the frame of a refrigeration cabinet, particularly a refrigerator-freezer combination. For applications of this type, the hinge mounting means are bracket means, which may be constructed, for example, of metal or plastic, which are removably attached by bolts, screws or adhesive means.

In the hinge of the present invention, the means for preventing rotation of the second hinge member with respect to the second mounting means actually prohibits the rotation of the second hinge member along the axis of rotation of the barrier means. This means comprises an elongaged member, adapted and configured for passage through the first hinge mounting member and thereafter through a substantially vertical aperture defined by the first and second hinge members.

The hinge may further comprise a collar member positioned and configured for engagement with the second hinge member as well as a retaining ring for snap locking engagement with the means for preventing rotation. For heavier duty applications the hinge material should have high strength characteristics, low surface friction and good resilience. Both the upper and the lower hinge member may be constructed of materials such as Delrin®, nylon or a metal which is sintered, wrought, machined or cast, ceramic material, or the like. Delrin® is a registered trademark of the DuPont Corporation of Wilmington, Del., for their engineering plastic which comprises an acetal homopolymer manufactured by the polymerization of formaldehyde.

The hinge of the present invention is preferably utilized for rotabably mounting a door to a refrigerator or a refrigerator/freezer combination. This hinge comprises first hinge mounting means defining at least one aperture and configured for removable attachment to a structural member of the frame means; second hinge mounting means having at least one aperture and configured for removable attachment to the door; a first hinge member mounted at a predetermined position in one of the apertures defined by the second mounting means, the first hinge member comprising a base portion extending upwardly in a substantially vertical direction which is configured for a corresponding interlocking fit within the aperture and a crown portion extending in a substantially vertical downward direction wherein the crown portion comprises a plurality of crenulations, each having two oppositely sloped sides.

The hinge assembly further comprises a second hinge member mounted at a predetermined orientation with respect to the first hinge member. The second hinge member comprises a base portion extending in a substantially vertical downward direction and a crown portion extending in a substantially vertical upward direction. The crown portion comprises a plurality of crenulations each having two oppositely sloped sided. The crenulations of the first and second hinge members have substantially identical dimensions. The predetermined orientation of the second hinge member is offset at a predetermined angle with respect to the position of the first hinge member.

Finally, the hinge assembly includes means for aligning the first and second hinge members in a substantially vertical position. The alignment means also serves to prevent the rotation of the second hinge member with respect to the first hinge mounting means.

We have also invented a method of making a hinge which comprises attaching a first hinge mounting means to structural support means, attaching a second hinge mounting means to barrier means, locating a first hinge member upon the second hinge mounting means, locating a second hinge member in predetermined offset engagement with the first hinge member and preventing the rotation of the second hinge member with respect to the first mounting means. The first hinge member is located upon the second hinge mounting means by inserting at least a base portion of the hinge member into an aperture defined by the second mounting means.

In the method described above, the first and second hinge mounting means may be attached to the structural support means and the barrier means, respectively, by inserting bolts or screws through at least one aperture defined by each of said mounting means.

In addition, the rotation of the second hinge member is prevented by inserting pin means through an aperture defined by the first and second hinge members in a substantialy vertical direction. The pin means comprises an elongated member, adapted and configured for passage through the aperture in the upper and lower hinge members, a collar member positioned and configured for engagement with a base portion of the second hinge member and a retaining ring for lockingly supporting the assembled hinge.

The invention disclosed herein is particularly effective for the attachment or a door to the frame of a refrigerator-freezer combination. In particular, applicants, method comprises attaching a first hinge mounting bracket to the frame of a refrigeration cabinet by inserting bolts or screws through at least one aperture defined by the first bracket; attaching a second hinge mounting bracket to the refrigerator door by inserting bolts or screws through at least one aperture defined by the second bracket, locating a first hinge member upon the second hinge mounting bracket by inserting at least a base portion of the first hinge member into an aperture defined by the second hinge mounting bracket; locating a second hinge member in predetermined offset engagement with the first hinge member, and inserting pin means through an aperture defined by the first and second hinge members in a substantially vertical direction to prevent the rotation of the second hinge member with respect to the first hinge mounting bracket.

BRIEF DESCRIPTION OF THE DRAWINGS

Further benefits and advantages of the invention will become apparent from a consideration of the following description given with reference to the accompanying drawing figures which specify and show preferred embodiments of the present invention, and wherein:

FIG. 3 is a cross-sectional view of the assembled hinge of FIG. 2;

FIG. 4 is a cross-sectional view taken along lines 4—4 of FIG. 3 which illustrates the configuration of the aperture within the collar member;

FIG. 5 is a view of the bottom of an assembled hinge, illustrating the orientation of the retaining ring which holds the assembly together;

FIG. 6 is a bottom plan view of the upper hinge member of the hinge of FIG. 3;

FIG. 7 is a side view of an upper hinge member;

FIG. 8 is a top view of an upper hinge member;

FIG. 11 is a top view of the upper hinge member of FIG. 9 which illustrates the preferred angular offset of the lip on the base portion;

FIGS. 12–15 are schematic representations of the orientation of the crenulations at various door positions;

FIG. 16 is a cross-sectional view of an alternate embodiment of the upper hinge of FIG. 3;

FIG. 17 is a cross-sectional view taken along lines 17—17 of FIG. 16;

FIG. 18 is a partial sectional view of an alternate embodiment of the upper hinge of FIG. 16; and FIG. 19 is a cross-sectional view of an alternate embodiment of the lower hinge of FIG. 10.

DETAILED DESCRIPTION OF THE PREFERRED EMBODIMENTS

The hinge of the invention may be utilized in applications involving both one door and two or more doors, mounted one above the other. This type of use is effectively demonstrated in the preferred emodiment of our invention which entails the mounting of doors upon a refrigeration cabinet or a refrigerator/freezer combination. The hinge may also be utilized to hold doors open for a display of availability, as for example, restroom stalls located in public lavoratories wherein the friction fit of the hinge must be overcome by the user in order to pull the door closed.

Figure 1:
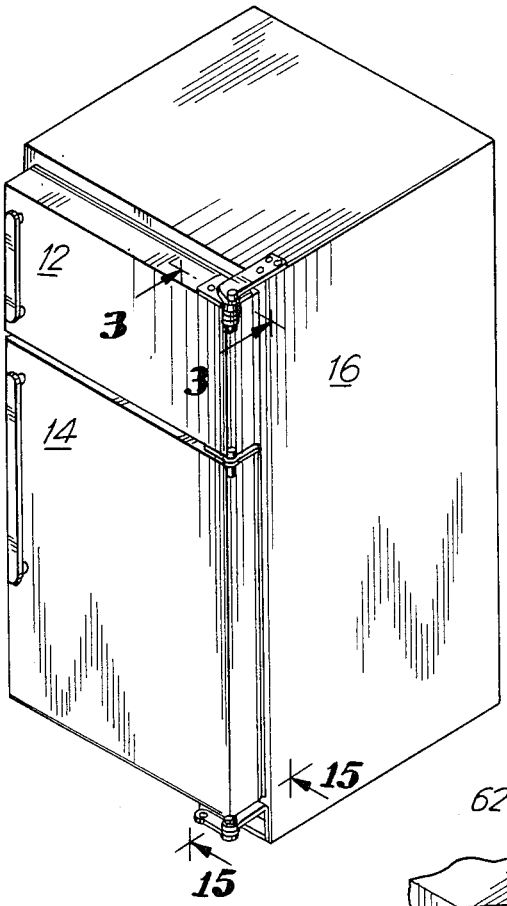
FIG. 1 is a perspective view of a refrigeration cabinet utilizing the hinge assembly of the invention.

Referring initially to FIG. 1 there is illustrated a perspective view of refrigeration cabinet 10 utilizing the hinge of the present invention to connect both upper 12 and lower 14 doors to frame 16 of cabinet 10.

For reasons of efficient space utilization it should be noted that door 12 and 14 each have only one controller hinge, constructed according to our invention, installed thereupon. This is clearly illustrated by FIG. 1. The hinge located between the two doors is of a type comprising simply a straight pin having a collar for separation and support. This configuration is utilized due to the limited amount of space between door 12 and door 14.

Figure 2:
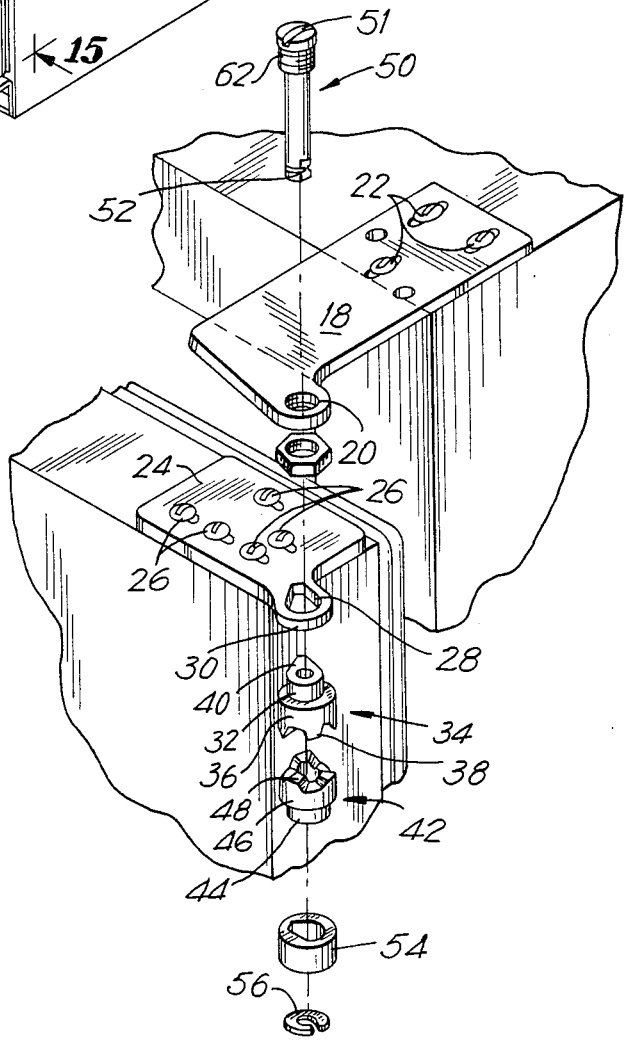
FIG. 2 is an exploded view of a hinge assembly door of the refrigeration cabinet of FIG. 1, illustrating its various subassemblies.

FIG. 2 is an exploded view of a hinge assembly as used for the mounting of upper door 12 onto frame 16 of cabinet 10.

Mounting means, such as bracket I8 containing aperture 20 is preferably secured by screws 22 onto frame 16. Bracket 18 may also be secured utilizing bolts, adhesives, by welding, etc. Thereafter, second mounting means, such as bracket 24 is also secured, preferably by screws 26, to the outside of the upper surface of door 12.

Bracket 24 on upper door 12 contains aperture 28 in flange 30 which serves to orient in a predetermined position, base portion 32 of upper hinge member 34. This orientation is effected by means of lip 40 on base portion 32 which is immovably engaged by correspondingly shaped aperture 28 in flange 30. Crown portion 36 of upper hinge member 34 is integrally associated with base portion 32 of upper hinge member 34. Crown portion 36 contains a plurality of crenulations 38, on its lower surface, each crenulation having two oppositely sloped sides Lower hinge member 42 is configured in a manner similar to that of upper hinge member 34 in that each member comprises base portion 44 constructed integrally with crown portion 46. Crown portion 46 also contains a plurality of crenulations 48 on its upper surface, each having two oppositely sloped sides.

Lower hinge member 42 is positioned below upper hinge member 34 and aligned so that the crenulations 48 of lower hinge member 42 extend in a substantially vertical upward direction to intersect, in offset alignment, with the crenulations 38 of upper hinge member 34. By offset alignment we mean that, with upper door 12 in a tightly closed position, the sloped sides of crenulations 38 on upper hinge member 34 are not perfectly aligned with the gaps between those crenulations 48 on lower hinge member 42. There is a slight gap between the surfaces (illustrated in FIG. 12 discussed below) due to a predetermined angle of offset between the upper 34 and lower 42 hinge members caused by the positioning of aperture 28 on flange 30 which orients the integral base portion 32 of upper hinge member 34. The resultant tendency of the crenulations located on the upper and lower hinge members to seek locking engagement with each other due to the weight of the door, serves to provide a force urging the door into closer contact with the structural member located on the frame of the refrigeration cabinet, thus conserving the cold air within the cabinet.

Pin 50 serves to align the hinge members in the proper position by passing through aperture 20 of bracket 18 and thereafter through a hollow bore extending in a substantially vertical downward direction through both upper 34 and lower 42 hinge members.

The base 52 of pin 50 is notched so as to form a "D" shaped cross-sectional configuration. Base portion 44 of lower hinge member 42 is also constructed with this "D" shaped configuration to allow the passage of the notched portion of the base 52 of pin 50 to pass therethrough.

A unique aspect of mounting brackets 18, 24 permits the alignment of the hinge assembly in the field, i.e., outside of the production line or the warehouse. The apertures for receiving screws (or bolts) 22, 26 are elongated, which permits the position of the bracket to be altered as necessary in order to keep the hinge members in alignment while permitting the door to maintain its "closed stop" and "open stop" positions.

In one embodiment of the present invention, the portion 62 of pin 50 proximal to pin head 51 may be D-shaped for insertion into correspondingly shaped aperture 20. Pin 50 may be retained within aperture 20 of upper mounting bracket 18 by a lock nut or lock washer, (See FIG.3, no. 51) or a set screw apparatus (not shown), or simply by the weight of door 12, wherein the entire assembly is held together by retaining ring 56. In place of retaining ring 56, an alternate embodiment of our invention utilizes a hexagonal head nut (not shown) to hold the hinge assembly together.

Upon exiting the base portion 44 of lower hinge member 42 in a substantially vertical downward direction, base portion 52 of pin 50 is engaged by a collar member 54 which will allow rotation of the hinge assembly when the door 12 of the refrigeration cabinet 10 is opened or closed. The assembly is then held together by means of a retaining ring 56 which surrounds the base 52 of pin 50 and locks the collar member 54 and hinge members 34, 42 into place.

The upper portion of collar member 54 contains a V-shaped aperture configured for engagement with the base portion 44 of lower hinge member 42. Base portion 44 is supplied with a lip portion 40 (not shown) since both the upper hinge member 34 and the lower hinge member 42 are interchangeable. In addition, the lower portion of collar member 54 contains a D-shaped aperture to accept the base 52 of pin 50 which also has a D-shaped cross-sectional configuration. This further prevents the lower, i.e., second, hinge member 42 from rotating with respect to mounting bracket 18.

An alternate embodiment (not illustrated) is to utilize as alignment means an integral extension of either upper 34 or lower 42 hinge member which would extend upward in a substantially vertical direction through aperture 28 and downward in the same manner through the collar member 54 so as to be locked into place by retaining ring 56.

Further, the upper 34 and lower 42 hinge members could be held in position without the aid of a retaining ring 56 if a horizontal set screw arrangement (not illustrated) was used wherein each hinge member was equipped with a set screw which passed horizontally through the member and engaged the surface of pin 50. The force thus created would maintain the position of upper 34 and lower 42 hinge members in a substantially vertical alignment with respect to one another.

Turning now to FIG. 3 there is illustrated a cross-sectional view of the assembled hinge of FIG. 2. Portions of the assembly previously described in the discussion of FIG. 2 have the same numerical designation in FIG. 3. This view does, however, more clearly illustrate the offset alignment of the crenulations 38, 48 as mentioned earlier in the discussion of FIG. 2.

With the upper door 12 in a tightly closed position, gaps 58, 60 exist between the crenulations of one hinge member and the corresponding space between the crenulations on the crown portion of the complementary hinge member. The effect of these gaps 58, 60 is, as noted above, to create a positive force pushing upper door 12 even more tightly closed against frame 16. This is due to the weight of upper door 12 which forces the crenulations of upper hinge member 34 and the corresponding gap between the crenulations of the lower hinge member 42 toward, but never quiet into, an interlocking engagement. This inability to achieve a locking engagement is maintained by virtue of the orientation chosen for the aperture 28 on second mounting bracket 24 which orients the upper hinge member 34 by means of lip 40.

FIG. 4 is a cross-sectional view taken along lines 4—4 of FIG. 3 which illustrates the "D" shaped configuration of collar member 54 which is configured to accept the notched portion of the base 52 of pin 50 which serves to align the hinge members.

FIG. 5 is a view of the bottom of the assembled hinge of FIGS. 2 and 3 showing the position of retaining ring 56 which surrounds base 52 of pin 50 and locks the collar member 54 and hinge members 34, 42 into place.

FIG. 6 is a bottom plan view of the crown portion of an upper hinge member as shown in FIGS. 2 and 3, with the base portion drawn in phantom. The four angles of 30° each represent that portion of the entire 360° circle which is occupied by: a positive or rising slope from the base toward the top of a crenulation (30°), the top surface of a crenulation (30°), a negative or descending slope (30°) and the gap between two crenulations (30°). In this preferred embodiment, there would be three crenulations (e.g., 360°÷120°=3) but one skilled in the art could envision hinge members with varying numbers of crenulations without undue experimentation by simply altering these angles.

The 10° angle depicted in FIG. 6 is illustrative of one orientation which may be chosen for mounting the upper hinge member 34 in aperture 28 in order to establish the offset alignment of the crenulations as previously discussed. In the preferred embodiment of the present invention, the applicant offsets the base position 32 of upper hinge member 34 by approximately ⅓ of the angle chosen for each segment of the crenulations (30°). Therefore, one-third of the preferred 30 angle allows for an offset of 10°. Other combinations of angles having the same offsetting effect may be utilized, which would be readily apparent to one skilled in the art.

FIG. 7 is a side view of lower hinge member 42 illustrating the planar surfaces of the positive or rising slope, the top of a crenulation, the negative or descending slope and the gap between two crenulations.

FIG. 8 is a top view of upper hinge member 34, further illustrating the 10° offset from the perpendicular of the lip 40 located upon base portion 32. The engagement of base portion 32 with lip 40 into aperture 28 of bracket 24 aligns the upper hinge member 34 so as to slightly offset the position of its crenulations 38 from those of lower hinge member 42. This offset alignment leads to the positive force discussed above, which serves to keep door 12 tightly closed.

Lip 40 may also be constructed in a hexagonal shape, a D-shape or any other shape which prevents rotation. This feature must, however, be constructed in a manner such that the hinge members maintain an offset alignment, the effect of which is discussed herein.

The upper door 12 and lower door 14 depicted in, for example, FIG. 1, may be converted from right-hand to left-hand opening doors without removing the hinges from the doors. One may simply move the mounting brackets from the frame and then turn the door over onto its other side. There is no need to remove the mounting brackets located on the doors themselves. This interchangeability provides additional economic inducement for adopting the hinge assembly which we have invented. Also the hinge and brackets may be reversed to the other side of the door leaving the door in the same orientation.

Figure 9:
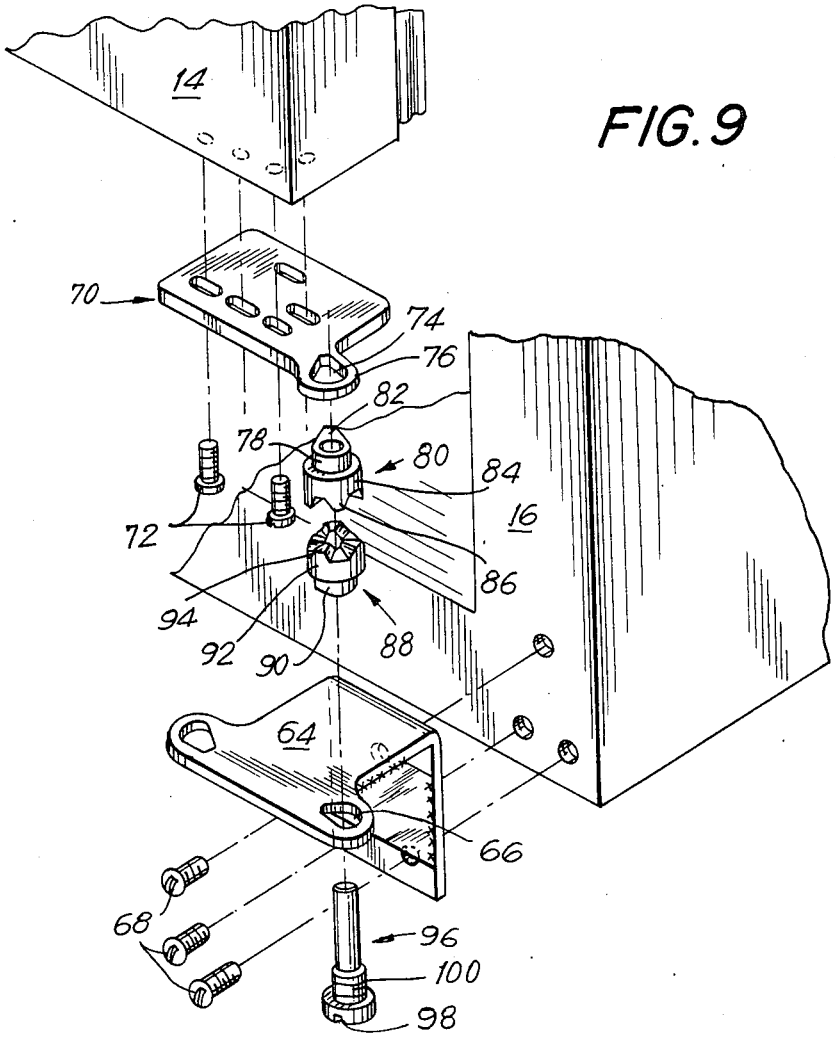
FIG. 9 is an exploded view of the apparatus as used to attach the lower door of the refrigeration cabinet of FIG. 1, illustrating its various subassemblies.

Turning to FIG. 9, there is illustrated an exploded view of the hinge apparatus used to attach lower door 14 of refrigeration cabinet 10. This hinge functions on the same principle as the hinge connecting upper door 12 to frame 16, illustrated in FIGS. 2 and 3 in that the weight of lower door 14 at the fulcrum provided by the hinge serves to urge the upper and lower hinge members together in the offset alignment described above.

In assembling this hinge, mounting means, such as bracket 64 containing at least one aperture 66 is secured by means such as screws 68 onto frame 16. Thereafter, second mounting means, such as bracket 70 is also secured by means such as screws 72 to the outside of the lower surface of door 14. Alternate embodiments of this invention may entail the use of bolts, rivets, adhesive means or other attachment means to attach the mounting means to the doors and the frame of refrigeration cabinet 10.

Bracket 70 on lower door 14 contains an aperture 74 in flange 76 which orients base portion 78 of hinge member 80 in a predetermined position. This orientation is effected by means of lip 82 which is immovably engaged by aperture 74 in flange 76.

Crown portion 84 of upper hinge member 80 is integrally associated with base portion 78 of upper hinge member 80. Further, crown portion 84 contains a plurality of crenulations 86 with oppositely sloped sides on its lower surface.

Lower hinge member 88 is configured in a manner similar to upper hinge member 80 in that it comprises base portion 90 constructed integrally with crown portion 92. Crown portion 92 contains a plurality of crenulations 94 having oppositely sloped sides on its upper surface.

Lower hinge member 88 is positioned below upper hinge member 80 and aligned so that the crenulations 94 of lower hinge member 88 extend in a substantially vertical upward direction to intersect in offset alignment with the downwardly extending crenulations 86 of upper hinge member 80.

Pin 96 serves to align the hinge members in the proper position by passing through aperture 66 of bracket 64 and thereafter through a hollow bore extending in a substantially vertical upward direction through both the lower 88 and upper 80 hinge members.

There is no need to notch the base of pin 96 as in the hinge assembly connecting upper door 12 to frame 16, depicted in FIGS. 2–4 because, by the insertion of pin 96 into the assembly from the bottom of the hinge, the weight of door 14 serves to keep the pieces together without the need for a collar member or retaining ring and, in this instance, pin 96 serves only as alignment means.

An alternate embodiment (not illustrated) is to utilize as alignment means an integral extension of either upper 80 or lower 88 hinge member which would extend in a substantially vertical direction through the complementary hinge member and through aperture 66 of bracket 64.

Figure 10:
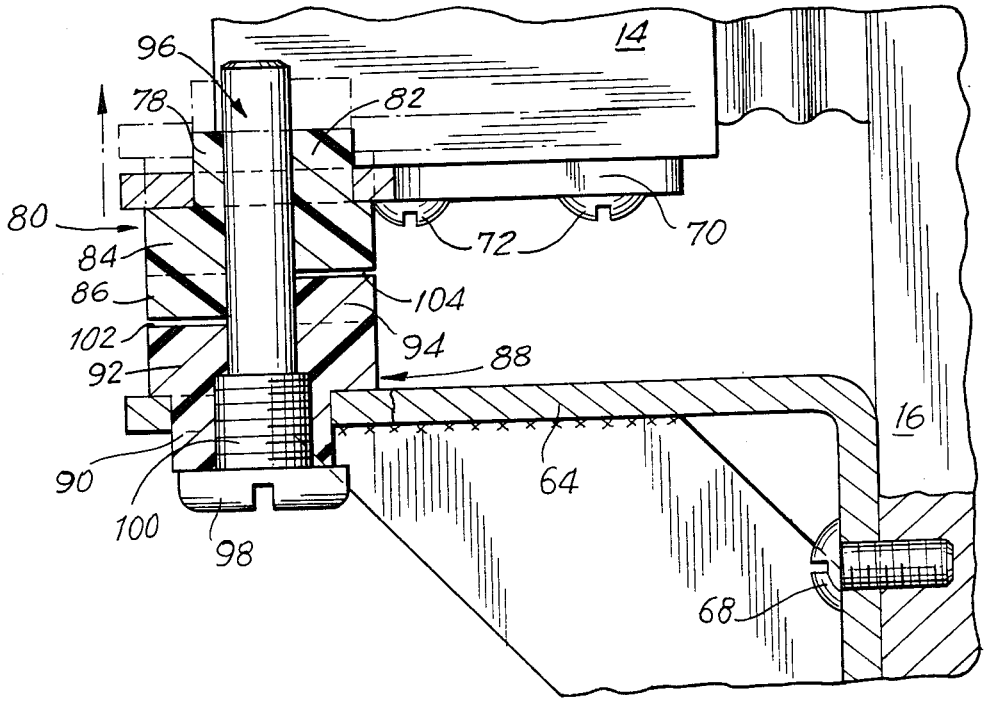
FIG. 10 is a cross-sectional view of the assembled hinge of FIG. 9.

FIG. 10 is a cross-sectional view of the assembled hinge of FIG. 9. Portions of the assembly previously described in the discussion of FIG. 9 have the same numerical designation in FIG. 10. This view further illustrates the offset alignment of crenulations 86 and 94 in that, with lower door 14 in a tightly closed position, gaps 102, 104 exist between the raised crenulations of one hinge member and the corresponding gap between two crenulations on the crown portion of the complementary hinge member.

When lower door 14 is in a closed position, the effect of these gaps 102, 104 is to create a positive force pushing lower door 14 even more tightly closed against frame 16. This effect is due to the weight of lower door 14 forcing the crenulations of upper hinge member 80 and the corresponding gap between the crenulations on lower hinge member 88 toward, but never quite into, an interlocking engagement. This offset alignment is achieved by virtue of the orientation chosen for aperture 74 on flange 76 of second mounting bracket 70 which orients the upper hinge member 80 by means of lip 82.

FIG. 11 is a top view of the upper hinge member 80 of FIG. 9 illustrating the preferred range of offset angle from the perpendicular of lip 82 on base portion 78. An alternate orientation for lip 82 is shown in phantom. The angle of 65° represents the preferred deviation from the perpendicular (approximately 32° in either direction) which will provide an effective offset alignment between the crenulations on the upper 80 and lower 88 hinge members.

FIGS. 12–15 are partial schematic representations showing the positions of the crenulations on the upper and lower hinge members when the door to which they are attached is moved to the indicated position, i.e. FIG. 12, door closed; FIG. 13, door open at 45° angle; FIG. 14, door opened at 90° angle and FIG. 15, door fully opened. The arrows indicate the direction of the force created when the door is moved.

For example, as illustrated in FIG. 12, where the door is closed, the weight of the door urges the crenulation of the upper hinge member into the gap between crenulations on the lower hinge member, thus creating a force which pushes the door closed, preserving the cold air within refrigeration cabinet 10 from any contact with the warmer air outside the cabinet.

FIG. 13 shows the positions of the crenulations on the upper and lower hinge members when the door is opened to an angle of approximately 45°. As shown by the arrow indicating the resultant force, the door, once placed in this position, tends to swing open further.

FIG. 14 illustrates what occurs when the door is opened to an angle of approximately 90° in that the resultant force between the crenulations also tends to swing the door open toward a more fully open position.

This fully open position is schematically illustrated in FIG. 15, which indicates that force must be applied to the hinge by manually adjusting the position of the door in order to break the interlock between the crenulations and allow the door to swing shut. Thus, a door placed in the open position will resist the tendency to swing shut due to the action of applicant's hinge, but rather it will remain open, allowing unhindered access to the contents of the cabinet.

FIG. 16 depicts an alternate embodiment of the upper hinge assembly which is illustrated in FIG. 3. Those aspects of the hinge which were previously described in the discussion of FIG. 3 above have been assigned the same numerical designations herein.

In the embodiment illustrated by FIG. 16, aperture 20 of bracket 18 has been provided with a D-shaped cross-sectional profile for engaging a notched upper portion 106 of pin 108. This upper portion of pin 108 is preferably threaded for insertion through brackets 24 and 18 and into threaded screw cap 110. The grip between the threads of pin 108 and those of screw cap 110 is further reinforced with the use of threaded lock nut 112. The upper portion 106 of pin 108 has a "D" shaped cross-section as shown in FIG. 17 and as utilized in the previously discussed embodiments of FIGS. 2 and 3. This cross-sectional configuration serves to prevent rotation of pin 108 and therefore, the lower hinge member 42 with respect to the upper mounting bracket 18.

Pin 108 extends downward in a substantially vertical direction from lock nut 112, through base portion 32 and crown portion 36 of upper hinge member 34 and thereafter through crown portion 46 and base portion 44 of lower hinge member 42. The effect of pin 108 therefore, as noted above, is to align upper 34 and lower 42 hinge members in position for proper operation of the upper hinge assembly according to the invention.

Upon exiting the base portion 44 of lower hinge member 42, the terminal portion of pin 108 is nested within collar member 116 which serves as a seat for the base portion 44 of lower hinge member 42. Collar member 116 is open at the base to allow the threaded attachment of lock nut or lock washer 114, which thereby maintains the hinge assembly in position.

FIG. 17 more clearly illustrates the D-shaped profile of aperture 20 defined by mounting bracket 18. This is a cross-sectional view taken along line 17—17 of FIG. 16. In this view of the upper notched portion 106 of pin 108 it is apparent that pin 108 does not rotate within aperture 20 but rather, the pin turns with bracket 18 as door 12 is opened, thus preventing rotation by lower hinge member 42 with respect to bracket 18.

In another embodiment of our invention, as illustrated in FIG. 18, the base 44 of lower hinge member 42 is shortened and thickened and provided with an aperture for the insertion of bolt means 122 having, for example, hexagonal head 124. Bolt 126 is therefore inserted upwardly through apertures located substantially through the center of lower hinge member 42 and upper hinge member 34 and thereafter through D-shaped aperture 20 defined by mounting bracket 18. The upper terminal portion (not shown) of bolt 126 is configured for insertion through aperture 20, wherein bolt 126 is maintained in position through the use of lock nuts or lock washers (not shown), as in FIG. 16. This enables us to omit collar member 54 and restraining clip 56 of the embodiment of FIGS. 2 and 3. However, it should be noted that when using this embodiment, the upper hinge member 34 and lower hinge member 42 are not interchangeable.

Turning now to FIG. 19 there is illustrated a cross-sectional view of an alternate embodiment for the lower hinge assembly which is illustrated in FIG. 10. Those features of the alternate embodiment which are the same as those of the embodiment described in FIG. 10 have been identified with the same number as used therein.

The embodiment disclosed in FIG. 19 entails the use of symmetrically shaped pin 118 having collar 120 to align upper 80 and lower 88 hinge members of the lower hinge assembly. Pin 118 is inserted in a substantially vertical direction in a hollow bore which exists substantially through both the upper 80 and lower 88 hinge members. The pin 118 is maintained in position within said base by an integrally formed collar 120 which is seated in a grooved area of crown portion 92 on lower hinge member 88.

There is no need to notch a portion of pin 118 as is the case for the upper portion 106 of pin 108 utilized in the upper hinge assembly because the weight of door 14 serves to hold upper 80 and lower 88 hinge members together. In this case, therefore, pin 118 serves only as an alignment means and it is held in position by collar 120.

Alternate embodiments of the hinge of the present invention may include attaching said hinge to a fence or gate post to support a gate which controls entry or exit through the fence. Another embodiment would involve the use of this hinge with a window which could be pushed or cranked open into a set position, which open position would then be retained by the action of the hinge.

While it is apparent that the invention herein disclosed is well calculated to fulfill the objects above stated, it will be appreciated that numerous modifications and embodiments may be devised by those skilled in the art, and it is intended that the appended claims cover all such modifications and embodiments as fall within the true spirit and scope of the present invention.

We claim:

1. A hinge for rotatably mounting a barrier member to structural means which comprises:

first hinge mounting means having means for attachment thereof to the structural means;

second hinge mounting means having means for attachment thereof to the barrier member and defining an aperture for demountable engagement of a hinge member;

first hinge member demountably positioned within said aperture of said second hinge mounting means for rotation with said second hinge mounting means;

second hinge member freely rotatable with respect to at least one of said hinge mounting means, and positioned at a predetermined offset angle relative to said first hinge member; and means for preventing rotation of said second hinge member with respect to said first mounting means;

said first and said second hinge members each having engaging surfaces correspondingly configured, which in conjunction with said offset positioning of said first and said second hinge members, facilitates staged rotation of said barrier member, said first hinge member and said second mounting means in predetermined sequential increments, the arc traversed thereby being determined by said respective engaging surfaces.

2. The hinge of claim 1 wherein said surfaces have corresponding engagement means to retain said first hinge member and said second mounting means in a predetermined position which thereby maintains the barrier member in at least one of a plurality of predetermined positions with respect to said structural means.

3. The hinge of claim 2 wherein said corresponding engagement means are configured so as to maintain said barrier member in at least three positions, which correspond to one opened position, one intermediate position and one closed position.

4. The hinge of claim 2 wherein said corresponding engagement means comprise a plurality of substantially identical crenulations, each having oppositely sloped sides.

5. The hinge of claim 1 wherein said barrier member is door means.

6. The hinge of claim 1 wherein the structural means comprises a frame member for a refrigerated cabinet.

7. The hinge of claim 6 wherein said refrigerated cabinet is a refrigerator-freezer combination.

8. The hinge of claim 1 wherein said hinge mounting means are bracket means.

9. The hinge of claim 8 wherein said bracket means are constructed of metal or plastic.

10. The hinge of claim 8 wherein said bracket means are removably attached by bolts, screws or adhesive means.

11. The hinge of claim 1 wherein said means for preventing rotation prohibits the rotation of said second hinge member along the axis of rotation of said barrier member.

12. The hinge of claim 1 wherein said means for preventing rotation comprises an elongated member adapted and configured for passage through said first hinge mounting means and thereafter through a substantially vertical aperture defined by said first and said second hinge members.

13. The hinge of claim 1 further comprising an annular collar member defining a D-shaped aperture through a central portion thereof and positioned and configured for engagement with a base portion of said second hinge member.

14. The hinge of claim 13 further comprising an arcuately configured retaining ring positioned parallel to and in contact with a lower surface of said collar member and adapted and configured for snap locking engagement with said means for preventing rotation.

15. The hinge of claim 1 wherein said first and said second hinge members are constructed of a material selected from the group consisting of Delrin®, nylon and metal.

16. A hinge for rotatably mounting a door to frame means of a refrigerator-freezer combination which comprises:

first hinge mounting means configured for removable attachment thereof to a structural member of said frame means said first hinge mounting means defining at least one aperture;

second hinge mounting means configured for removable attachment thereof to said door, said second mounting means defining at least one aperture;

a first hinge member mounted at a predetermined position in one of said at least one apertures defined by said second mounting means for rotation with said second mounting means, said first hinge member comprising a base portion extending upwardly in a substantially vertical direction configured for a corresponding interlocking fit within said aperture and a crown portion extending in a substantially vertical downward direction, said crown portion comprising a plurality of crenulations, each having two oppositely sloped sides;

a second hinge member mounted at a predetermined orientation with respect to said first hinge member, said second hinge member comprising a base portion extending in a substantially vertical downward direction and a crown portion extending in a substantially vertical upward direction, said crown portion comprising a plurality of crenulations, each having two opositely sloped sides, said crenulations of said first and said second hinge members having substantially identical dimensions;

said predetermined orientation of said second hinge member being offset at a predetermined angle with respect to the position of said first hinge member; and means for alignment of said first and said second hinge members in a substantially vertical position wherein said alignment means serves further to prevent the rotation of said second hinge member with respect to said first hinge mounting means.

17. A method for making a hinge assembly which comprises:

attaching a first hinge mounting means to a structural support means;

attaching a second hinge mounting means to a barrier means;

locating a first hinge member upon said second hinge mounting means by inserting at least a base portion of said first hinge member into an aperture defined by said second hinge mounting means;

locating a second hinge member in predetermined offset engagement with said first hinge member; and preventing rotation of said second hinge member with respect to said first mounting means by inserting separate, removable pin means through an aperture defined by said first and said second hinge member in a substantially vertical direction, said first and said second hinge mounting means being attached to said structural means and said barrier means, respectively, by inserting at least one bolt or screw through at least one aperture defined by each of said mounting means.

18. The method of claim 17 wherein said pin means comprises:

an elongated member adapted and configured for passage through the aperture in said upper and said lower hinge members;

an annular collar member defining a D-shaped aperture through a central portion thereof and positioned and configured for engagement with a base portion of said second hinge member; and an arcuately configured retaining ring positioned parallel to and in contact with a lower surface of said collar member and adapted and configured for snap locking engagement with said pin for lockingly supporting the assembled hinge.

19. The method of claim 17 wherein said structural support means is a portion of frame means for a refrigeration cabinet.

20. The method of claim 17 wherein said barrier means is a door.

21. A method of making a hinge which comprises attaching a first hinge mounting bracket to a refrigeration cabinet frame means by inserting bolts or screws through at least one aperture defined by said first bracket;

attaching a second hinge mounting bracket to door means for said refrigeration cabinet by inserting bolts or screws through at least one aperture defined by said second bracket;

locating a first hinge member upon said second hinge mounting bracket by inserting at least a base portion of said first hinge member into an aperture defined by said second hinge mounting bracket;

locating a second hinge member in predetermined offset engagement with said first hinge member; and inserting pin means through an aperture defined by said first and said second hinge members in a substantially vertical direction to prevent the rotation of said second hinge member with respect to said first hinge mounting bracket.

22. The hinge according to claim 1 wherein said first and second hinge members are similarily and correspondingly configured to facilitate mounting said barrier member to said structure means for left hand or right hand rotation.

23. The hinge according to claim 3 wherein each hinge member includes three crenulations corresponding to three positions of said barrier member, said crenulations being rotationally separated from each other by approximately 120 degrees(°).

24. The hinge according to claim 23 wherein said first and second hinge members are similarly and correspondingly configured to facilitate mounting said barrier member to said structural means for left hand or right hand rotation by either rotating the barrier position or by reversing the hinges.

* * * * *